US010145645B2

(12) United States Patent
Song

(10) Patent No.: US 10,145,645 B2
(45) Date of Patent: Dec. 4, 2018

(54) DEVICE FOR TRANSMITTING BOW STRING RELEASE SIGNAL, DEVICE FOR RECEIVING BOW STRING RELEASE SIGNAL AND BOW STRING RELEASE HAVING THE SAME

(75) Inventor: In Gyu Song, Busan (KR)

(73) Assignee: Yoonjae Song, Busan (KR)

( * ) Notice: Subject to any disclaimer, the term of this patent is extended or adjusted under 35 U.S.C. 154(b) by 156 days.

(21) Appl. No.: 13/408,848

(22) Filed: Feb. 29, 2012

(65) Prior Publication Data

US 2013/0220292 A1 Aug. 29, 2013

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469; F41B 5/148; B63C 11/186; A61M 15/005; A61M 16/049; A61C 7/36; A63B 71/085; A63B 21/00196; A63B 23/18
USPC ..... 124/35.2
See application file for complete search history.

(56) References Cited

U.S. PATENT DOCUMENTS

| | | | | |
|---|---|---|---|---|
| 4,232,649 | A | 11/1980 | Allen et al. | |
| 4,485,798 | A | 12/1984 | Hamm | |
| 4,556,041 | A | 12/1985 | Prescott et al. | |
| 4,979,516 | A * | 12/1990 | Abraham, II | A61B 5/228 128/862 |
| 5,205,268 | A * | 4/1993 | Savage | 124/24.1 |
| 5,499,633 | A * | 3/1996 | Fenton | A61F 5/566 128/848 |
| 5,566,664 | A | 10/1996 | Todd | |
| 6,089,864 | A * | 7/2000 | Buckner et al. | 433/71 |
| 6,198,459 | B1 * | 3/2001 | Rowe | G09F 19/00 116/209 |
| 7,675,429 | B2 * | 3/2010 | Cernasov | 340/4.11 |

* cited by examiner

*Primary Examiner* — Melba Bumgarner
*Assistant Examiner* — Amir Klayman
(74) *Attorney, Agent, or Firm* — Birch, Stewart, Kolasch & Birch, LLP

(57) ABSTRACT

Disclosed herein is a device that releases a bow string in response to engagement of parts fitted over the teeth of a user. The present invention provides a release signal transmitting device that includes at least one switching means and a signal transmitter, and a release signal receiving device that includes a signal receiver, a controller and an actuator. The release signal transmitting device has a mouthpiece structure that is fitted over the teeth of the user. The release signal receiving device has a shooting mechanism that is interlocked to the actuator.

5 Claims, 4 Drawing Sheets

[Fig. 1] PRIOR ART
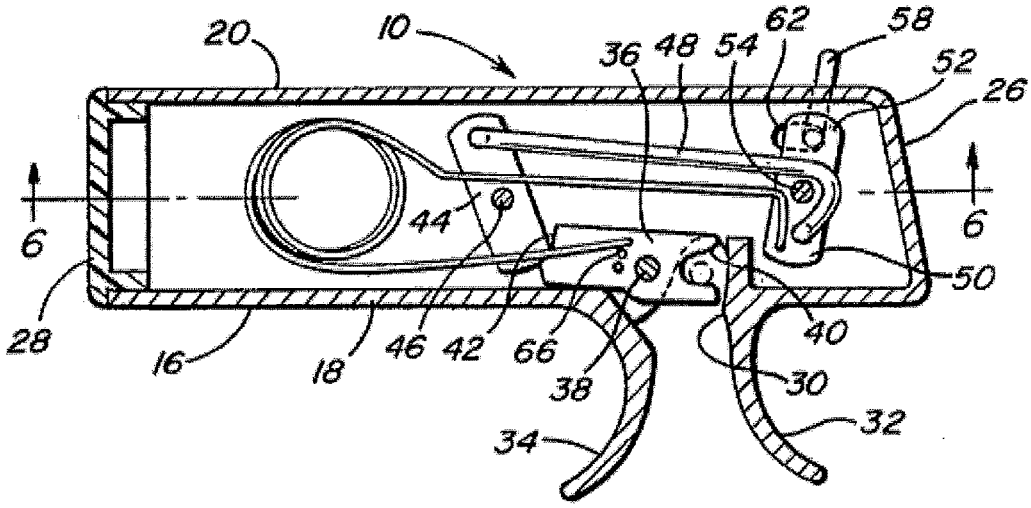
[Fig. 2] PRIOR ART
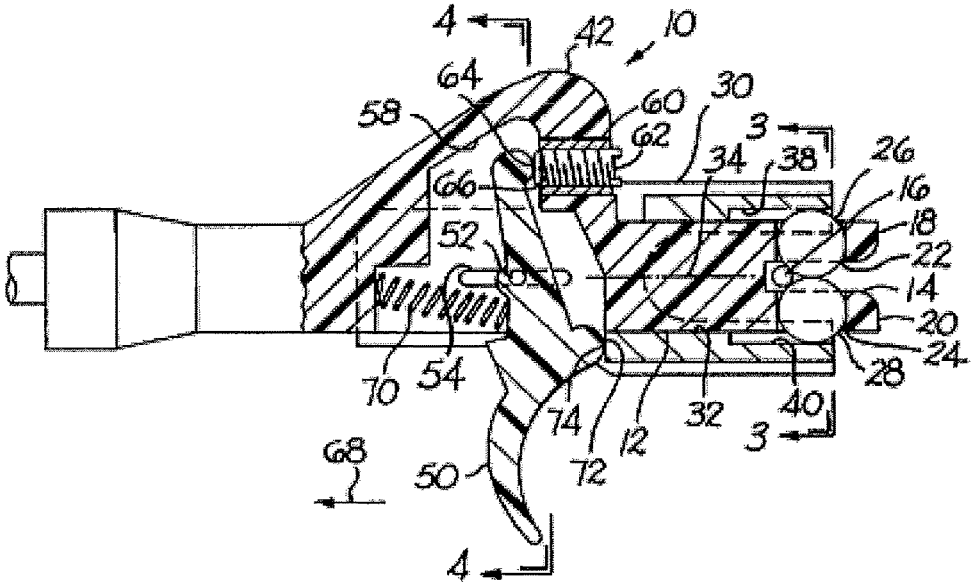

[Fig. 3]
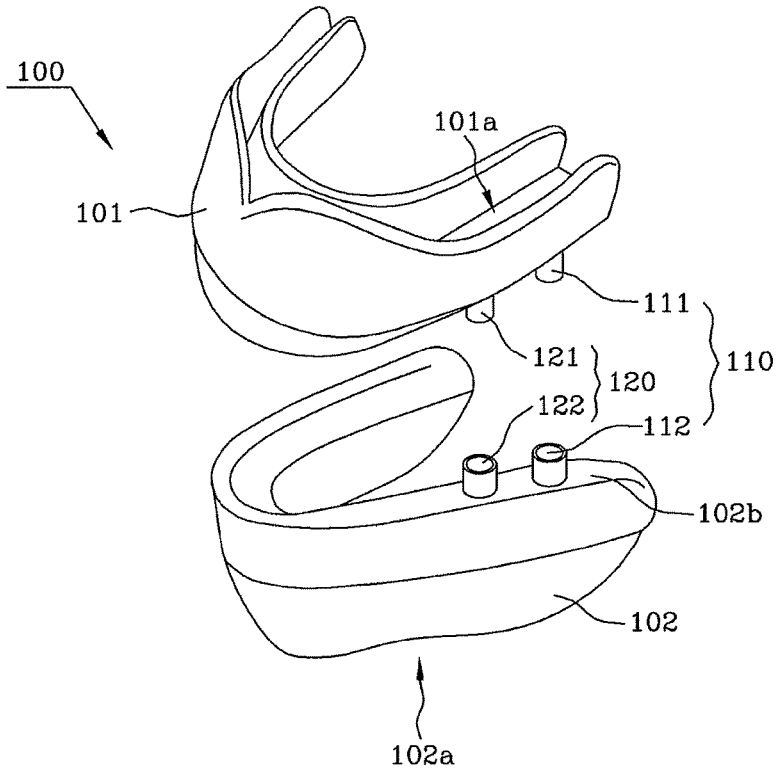
[Fig. 4]
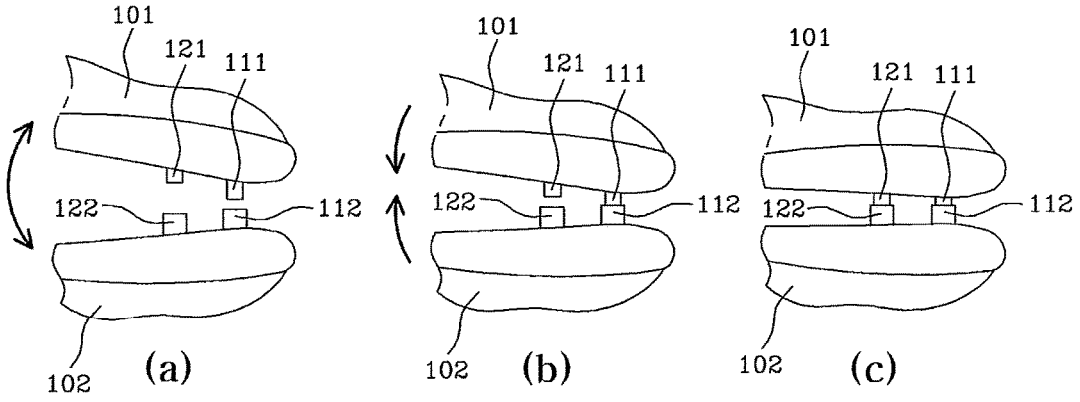

[Fig. 5]
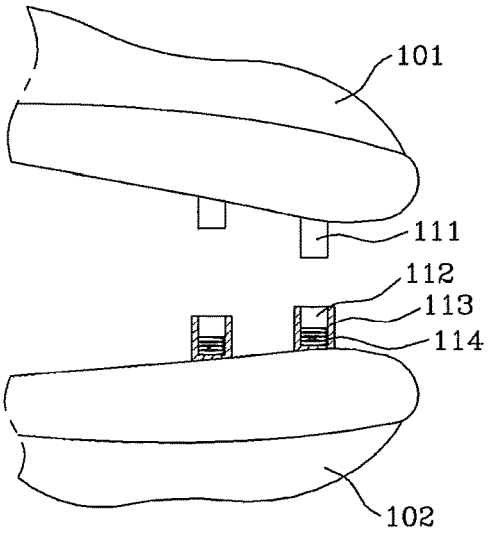
[Fig. 6]
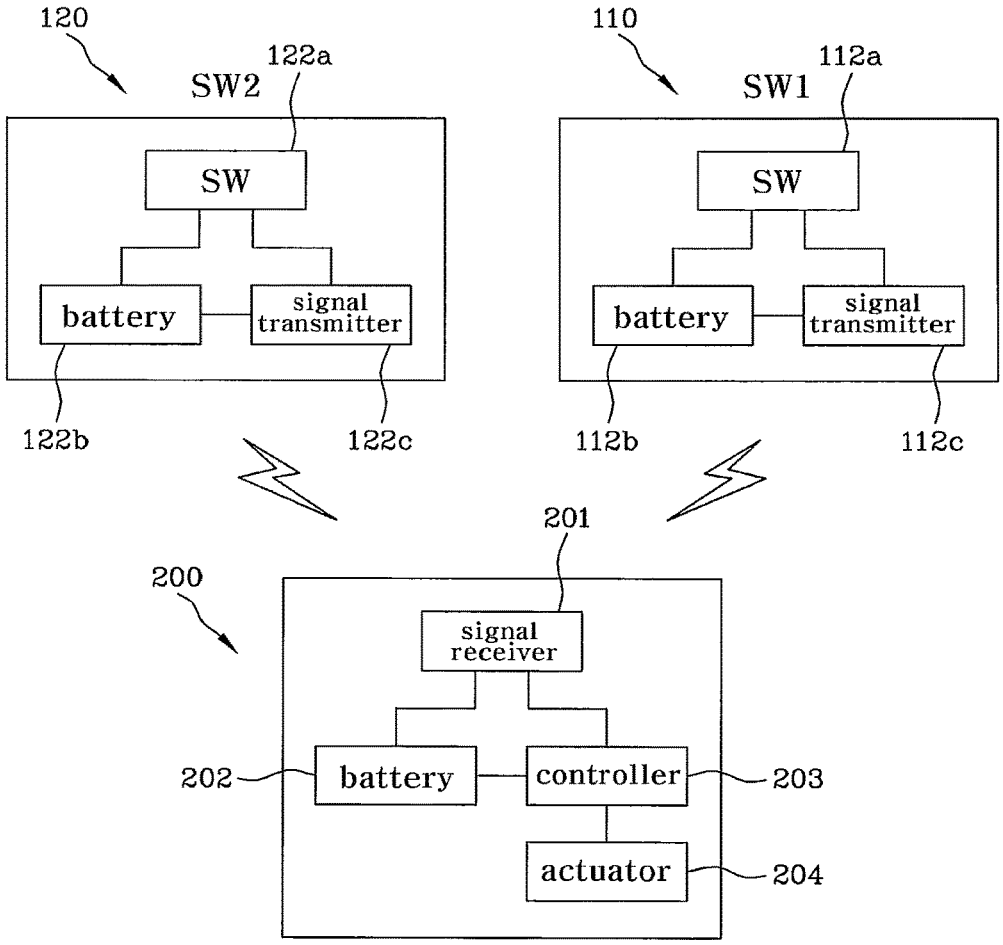

[Fig. 7]
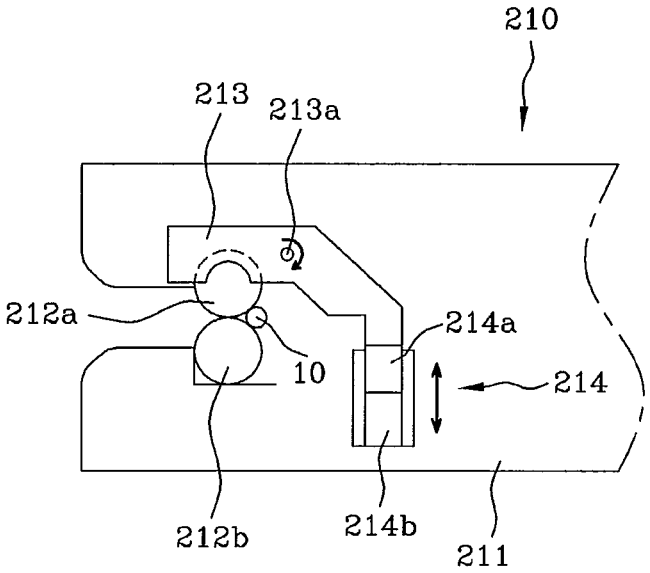

DEVICE FOR TRANSMITTING BOW STRING RELEASE SIGNAL, DEVICE FOR RECEIVING BOW STRING RELEASE SIGNAL AND BOW STRING RELEASE HAVING THE SAME

BACKGROUND OF THE INVENTION

1. Field of the Invention

The present invention relates generally to a bow string release that pulls a bow string and releases it and, more particularly, to a device that can create an arrow shooting signal only using the mouth of a user without moving the hand, thus mitigating a problem of the accuracy of the arrow being reduced by unstable breathing, shaking, vibration, etc. which may occur when the user operates a bow string release using his/her hand.

2. Description of the Related Art

Bows and arrows have been used as means for leisure, sports, training of the mind and body, hunting, etc. for a long period of time. To enhance the accuracy rate to a target object such as a mark or game and the straight driving ability of an arrow, there has been continuous research and development conducted on bows and arrows.

There have thus been ongoing efforts to enhance the performance of bows and arrows on arrow shafts, the feathers of arrows, the notches of arrows and the structure and material of bows. Recently, disclosed have been different kinds of bow string releases that can prevent the accuracy rate of an arrow from becoming lowered due to unstable breathing or shaking just as a user releases a bow string.

FIGS. 1 and 2 are sectional views showing examples of conventional bow string releases. FIG. 1 illustrates a bow string release proposed in U.S. Pat. Registration No. 4,556,041, entitled "BOW STRING GRIP AND RELEASE". FIG. 2 illustrates a bow string release proposed in U.S. Pat. Registration No. 5,566,664, entitled "BOW STRING RELEASE WITH ROLLER STRING RETENTION MEMBER".

The technique of FIG. 1 is configured such that touching a tap 58 sensitively opens an opening notch 40, to which a bow string 12 is hooked, so that the bow string 12 is released.

The technique of FIG. 2 is configured such that a pair of rollers 26 that hold a bow string 16 on rear portions thereof releases the bow string 16 when a user pulls a trigger 50.

Such bow string releases can reduce shaking of a bow when a user directly holds the bow string with his/her hand and pulls and releases it, thus enhancing the accuracy rate.

However, the conventional bow string releases cannot still completely prevent the bow from shaking or vibrating, although they can reduce the shaking or vibration compared to that when the user directly holds the bow string.

Moreover, the conventional bow string releases all are configured such that even a very light touch can release the bow string. The reason for this is because an impact generated when releasing the bow string can be minimized. However, the structure of releasing the bow string is excessively sensitive so that accidental release of the arrow is frequently caused even by a small shock or touch.

Arrows are weapons capable of killing people, so that if an arrow is involuntarily shot, a fatal accident may occur.

Therefore, a technique is required that can minimize an impact or shaking from occurring when releasing a bow string and prevent carelessness or unintentional motion of the user from allowing an arrow to be shot.

PRIOR ART DOCUMENTS

[Patent Document]

U.S. Pat. Registration No. 4,556,041 "BOW STRING GRIP AND RELEASE"

U.S. Pat. Registration No. 5,566,664 "BOW STRING RELEASE WITH ROLLER STRING RETENTION MEMBERS"

U.S. Pat. Registration No. 4,485,798 "BOW STRING RELEASE"

U.S. Pat. Registration No. 4,232,649 "BOW STRING TRIGGER RELEASE"

SUMMARY OF THE INVENTION

Accordingly, the present invention has been made keeping in mind the above problems occurring in the prior art, and an object of the present invention is to use a bow string release, rather than a structure such that a user directly pulls a bow string with his/her hand, and minimizes vibration, shaking or an impact from occurring when releasing the bow string, thus enhancing the accuracy rate of and the flight stability of an arrow.

In particular, the present invention provides a mouthpiece type bow string release that enables a user to control a shooting timing unlike the conventional trigger type bow string releases in which probability of an accidental shooting is comparatively high.

In order to accomplish the above object, in an aspect, the present invention provides a device for transmitting a bow string release signal to a bow-string-release-signal receiving device that pulls a bow string and holds the bow string in a pulled position, the device for transmitting, including: an upper mouthpiece configured to be disposed on upper teeth of a user; a lower mouthpiece configured to be disposed on lower teeth of the user; a first push unit provided on and protruded from one selected from between the upper and lower mouthpieces; and a first pressure receiving unit provided on a remaining one of the upper and lower mouthpieces and adapted to receiving the first push unit, the first pressure receiving unit having a first switching element sensing a contact between the first push unit and the first pressure receiving unit, and a first signal transmitter transmitting a sensing signal of the first switching element to the bow-string-release-signal receiving device.

The device for transmitting may further include: a second push unit provided on and protruded from one selected from between the upper and lower mouthpieces; and a second pressure receiving unit provided on a remaining one of the upper and lower mouthpieces and adapted to receiving the second push unit, the second pressure receiving unit having a second switching element sensing a contact between the second push unit and the second pressure receiving unit, and a second signal transmitter transmitting a sensing signal of the second switching element to the bow-string-release-signal receiving device.

The contact between the first push unit and the first pressure receiving unit and the contact between the second push unit and the second pressure receiving unit may be successively performed.

In another aspect, the present invention provides a device for receiving a signal to release a bow string, the signal being created by and transmitted from a bow-string-release-signal transmitting device that is disposed on upper and lower teeth of a user, the device for receiving, releasing the bow string in response to the signal and including: a signal receiver receiving the transmitted signal; a controller creating a control command when the signal is received; and an actuator opening a string holder in response to the control command of the controller, the string holder having held the bow string.

In a further aspect, the present invention provides a bow string release, including: the device for transmitting a bow string release signal; and the device for receiving a bow string release signal.

The present invention can reliably prevent carelessness or unintentional motion of a user from allowing an arrow to be involuntarily shot, unlike the conventional bow string releases that are entirely controlled by the hand of the user.

In the present invention, the user manipulates a switching means for shooting the arrow using his/her mouth which is more sensitive than the hand, thus minimizing shaking, vibration and a jolt occurring the moment the arrow is shot, thereby enhancing the accuracy rate. The switching means has a multi-step structure so that the arrow can be prevented from being involuntarily shot and the user can precisely control a shooting timing of the arrow.

Furthermore, the present invention is configured such that a signal transmitting device of the mouthpiece transmits information about the shooting timing of the arrow to a signal receiving device that holds the bow string through wire/wireless communication, and an actuator installed in the signal receiving device releases the bow string in response to the transmitted information. Therefore, the structure of the bow string release can be simplified.

BRIEF DESCRIPTION OF THE DRAWINGS

The above and other objects, features and advantages of the present invention will be more clearly understood from the following detailed description taken in conjunction with the accompanying drawings, in which:

FIGS. 1 and 2 are sectional views showing examples of conventional bow string releases;

FIG. 3 is a perspective view of a device for transmitting a bow string release signal, according to an embodiment of the present invention;

FIGS. 4A through 4C are views illustrating the operation of the release signal transmitting device according to the present invention;

FIG. 5 is a schematic view showing an example of the construction of a switching means of the release signal transmitting device according to the present invention;

FIG. 6 is of views showing the internal construction of the bow-string-release-signal transmitting device and a bow-string-release-signal receiving device according to the present invention; and FIG. 7 is a view showing the construction of a shooting unit of a device for receiving a bow string release signal, according to an embodiment of the present invention.

DESCRIPTION OF THE PREFERRED EMBODIMENTS

Hereinafter, the construction and operating principles of the present invention will be described in detail with reference to the attached drawings.

FIG. 3 is a perspective view of a device 100 for transmitting a bow string release signal, according to an embodiment of the present invention. FIGS. 4A through 4C are views illustrating the operation of the bow-string-release-signal transmitting device 100 according to the present invention. FIG. 5 is a schematic view showing an example of the construction of a switching means of the bow-string-release-signal transmitting device 100 according to the present invention. FIG. 6 is of views showing the internal construction of the bow-string-release-signal transmitting device 100 and a bow-string-release-signal receiving device 200 according to the present invention A bow string release according to the present invention includes the bow-string-release-signal transmitting device 100 and the bow-string-release-signal receiving device 200 which are provided in a pair and correspond to each other.

The bow-string-release-signal transmitting device (100, hereinafter referred simply to as the release signal transmitting device) is of the shape of a mouthpiece. Preferably, the release signal transmitting device 100 includes an upper mouthpiece 101 which is mounted to the upper teeth of a user, and a lower mouthpiece 102 which is mounted to the lower teeth of the user.

A first push unit 111 and a second push unit 121 are provided on the upper mouthpiece 101 at positions spaced apart from each other by a predetermined distance in positional sequence from the rear to the front. In the same manner, a first pressure receiving unit 112 and a second pressure receiving unit 122 are provided on the lower mouthpiece 102 at positions spaced apart from each other by a predetermined distance in positional sequence from the rear to the front.

Of course, the first push unit 111 and the second push unit 121 may be provided on the lower mouthpiece 102, and the first pressure receiving unit 112 and the second pressure receiving unit 122 may be provided on the upper mouthpiece 101.

The first push unit 111 and the first pressure receiving unit 112 are located in positions at which they come into contact with each other when the upper and lower teeth of the user engage with each other. The locations of the second push unit 121 and the second pressure receiving unit 122 are determined in the same manner. In other words, when the user closes the mouth so that the upper and lower mouthpieces 101 and 102 that are mounted to the user's teeth engage with each other, the first push unit 111 comes into contact with the first pressure receiving unit 112 and the second push unit 121 subsequently comes into contact with the second pressure receiving unit 122.

A pair of the first push unit 111 and the first pressure receiving unit 112 refers to a first switching means 110. A second switching means 120 designates a pair of the second push unit 121 and the second pressure receiving unit 122.

Although this embodiment of the present invention has two switching means, it may have a single switching means as necessary. In other words, only the first switching means 110 may be provided on the mouthpieces 101 and 102.

If two switching means are provided as in this embodiment including the first and second switching means 110 and 120, which are arranged in a line, accidental shooting can be more reliably prevented. That is, the present invention is configured such that while the user closes the mouth and the upper and lower mouthpieces 101 and 102 engage with each other, the first and second switching means 110 and 120 are successively pushed at a distance of time. Only when the second switching means 120 is pushed after the first switching means 120 has been pushed can the bow string be released.

For this, it is preferable for a protruding length of the first push unit 111 to be longer than that of the second push unit 121.

FIG. 4 illustrates the operation of the switching means 110 and 120 according to the angle at which the upper and lower mouthpieces 101 and 102 engage with each other. As shown in FIG. 4B, when only the first switching means 110 is turned ON, a lamp or buzzer that is attached to a device for receiving a bow string release signal that will be explained later herein is operated to signal to be in a standby mode. When the second switching means 120 is also turned ON after the first switching means 110 has been turned ON, the bow string is eventually released so that an arrow is shot.

As shown in FIG. 5, the first and second pressure receiving units 112 and 122 may be configured such that when each of the second push units 111 and 121 pushes the corresponding pressure receiving unit 112, 122, the pressure receiving unit 112, 122 elastically moves backwards in a casing 113 while overcoming the elastic force of an elastic means 114 installed in the casing 113. In this case, the push unit 111, 121 can be prevented from damaging the teeth when pushing the pressure receiving unit 112, 122, and the switching means can be more smoothly operated.

As shown in FIG. 6, each of the first and second switching means 110 and 120, in particular, each of the first and second pressure receiving units 112 and 122, has a switching element 112*a*, 122*a*, a battery 112*b*, 122*b* and a signal transmitter 112*c*, 122*c*.

Each switching element 112*a*, 122*a* may comprise a known switching element, such as a contact or pressure point switch or the like. Any type signal transmitter may be used as each signal transmitter 112*c*, 122*c*, so long as it can transmit an ON or OFF signal pulse to a bow-string-release-signal receiving device (200, hereinafter referred to as a 'release signal receiving device') through wire/wireless communication.

The release signal receiving device 200 includes a signal receiver 201 which receives a release signal, a battery 202 which supplies power, a controller 203 which analyzes the release signal of the signal receiver 201 and transmits a control command, and an actuator 204 which receives the control command and is operated in response to the control command.

The actuator 204 may comprise any shape or structure of device, such as a linear motor, a step motor, a relay, a limit switch, etc., so long as it can linearly move or rotate so that the bow string can be released.

FIG. 7 is a view showing the construction of a shooting unit 210 of the release signal receiving device 200, according to an embodiment of the present invention. FIG. 7 illustrates an example of the construction of the actuator that has received a control command.

In this embodiment, two rollers 212*a* and 212*b* are provided in the release signal receiving device 200, and a bow string 10 is held by rear portions of the rollers 212*a* and 212*b*. The upper roller 212*a* of the two rollers 212*a* and 212*b* is retained by a link bar that refers to a string holder 213.

A lower end of the string holder 213 is connected to a linear actuator 214. When the release signal receiving device 200 receives a release signal, the linear actuator 214 is operated and moved linearly downwards.

Then, the string holder 213 rotates around a pivot 213*a*. The upper roller 212*a* is eventually lifted. As a result, the bow string 10 can be smoothly released without resistance.

A linear motor or a linear slide device may be used as the linear actuator 214. In the drawing, the reference numeral 214*b* denotes a slide rail, and 214*a* denotes a slider that linearly moves along the slide rail 214*b*. Further, the reference numeral 211 denotes a housing of the release signal receiving device 200. In FIG. 7, the remaining elements of the release signal receiving device 200 are omitted for the sake of convenience of the description.

In the bow string release of this embodiment, to pull the bow string, the slider 214*a* moves downwards so that the upper roller 212*a* is lifted. After the user inserts the bow string into the shooting unit 210 through the space between the rollers 212*a* and 212*b*, the linear actuator 214 moves upwards again so that the bow string is held by the rollers 212*a* and 212*b*. Subsequently, as described above, when two successive switching ON signals are received from the first and second switching means 110 and 120, the bow string is released.

In the present invention, the user has the bow string release with the bow string held by the release signal receiving device 200 and, when necessary, for example, when game appears, the user immediately turns on the power of the release signal receiving device and then releases the bow string at a proper moment, thus shooting an arrow.

Although power switches of the release signal transmitting device 100 and the release signal receiving device 200 have not been illustrated in the above description, each of the devices 100 and 200 has a power switch. Therefore, even when the user is gripping the mouthpiece type transmitting device in his/her mouth, if it is unnecessary, the release signal transmitting device 100 or the release signal receiving device 200 may be turned off. In other words, even though the user is gripping the transmitting device in his/her mouth, it can be used only when necessary so that an arrow is shot.

If such a power ON/OFF function is applied to a hunting bow, it can be very conveniently used. For example, the user always maintains the bow string in a state of having been held by the string holder 213 of the release signal receiving device 200 and searches for game while the release signal transmitting device 100 or the release signal receiving device 200 is being turned off. As soon as the user finds out a target, he/she can turn on the device 100 or 200 and shoot an arrow without needing to put the bow string to the held position again.

The power switch functions as a kind of safety device. The power switch may be configured such that when the bow string is pulled after the bow string has been put in the release signal receiving device 200, the power switch is turned on.

As described above, in the present invention, a switching element of a mouthpiece gripped in the mouth of a user determines whether shooting an arrow. Compared to when the user controls a bow string release with his/her hand and determines the shot of an arrow, the present invention can markedly reduce the shaking of the bow string and remove a probability of accidental shooting, thus enhancing safety.

Furthermore, the present invention can be used in an extensive range of bows, for example, for leisure, sports, training the mind and body, hunting, etc. In particular, in the case where the present invention is used in a bow for hunting, a shooting accident can be prevented from occurring while searching and pursuing game.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for transmitting a bow string release signal to a bow-string-release-signal receiving device that pulls a bow string and holds the bow string in a pulled position, the device for transmitting comprising:

an upper mouthpiece configured to be disposed on upper teeth of a user, the upper mouthpiece having an inner surface configured to contact a user's teeth and an outer surface;

a lower mouthpiece configured to be disposed on lower teeth of the user, the lower mouthpiece having an inner surface configured to contact a user's teeth and an outer surface;

a first push unit provided on and protruded from the outer surface of one selected from between the upper and lower mouthpieces;

a first pressure receiving unit provided on the outer surface of a remaining one of the upper and lower mouthpieces and configured to receive the first push unit, the first pressure receiving unit comprising a first switching element sensing a contact between the first push unit and the first pressure receiving unit, and a first signal transmitter transmitting a sensing signal of the first switching element to a bow-string-release-signal receiving device, wherein the first push unit and the first pressure receiving unit are located in positions at which they come into contact with each other when the upper and lower teeth of the user engage with each other, wherein the first pressure receiving unit comprises a casing having an inner surface defining a central recess and an outer surface, wherein the first push unit comprises a column having an outer surface, wherein a diameter of the inner surface of the casing is larger than a diameter of the outer surface of the column, and wherein the first switching element is retained within the central recess of the casing and supported by an elastic member;

a second push unit provided on and protruded from one selected from between the upper and lower mouthpieces; and a second pressure receiving unit provided on a remaining one of the upper and lower mouthpieces and configured to receive the second push unit, the second pressure receiving unit comprising a second switching element sensing a contact between the second push unit and the second pressure receiving unit, and a second signal transmitter transmitting a sensing signal of the second switching element to the bow-string-release-signal receiving device, wherein the second push unit and the second pressure receiving unit contact each other when the upper and lower teeth of the user engage with each other, and wherein the contact between the first push unit and the first pressure receiving unit and the contact between the second push unit and the second pressure receiving unit are successively performed.

2. The device for transmitting as set forth in claim 1, wherein the first pressure receiving unit protrudes from one selected from the upper and lower mouthpieces.

3. A bow string release, comprising:

the device for transmitting according to claim 1; and a device for receiving a signal to release a bow string, the signal being created by and transmitted from a bow-string-release-signal transmitting device that is disposed on upper and lower teeth of a user, the device for receiving, releasing the bow string in response to the signal and comprising:

a signal receiver receiving the signal;

a controller creating a control command when the signal is received; and an actuator opening a string holder in response to the control command of the controller, the string holder having held the bow string.

4. A device for transmitting a bow string release signal to a bow-string-release-signal receiving device that pulls a bow string and holds the bow string in a pulled position, the device for transmitting comprising:

an upper mouthpiece configured to be disposed on upper teeth of a user;

a lower mouthpiece configured to be disposed on lower teeth of the user;

a first push unit provided on and protruded from one selected from between the upper and lower mouthpieces;

a first pressure receiving unit provided on a remaining one of the upper and lower mouthpieces and configured to receive the first push unit, the first pressure receiving unit comprising a first switching element sensing a contact between the first push unit and the first pressure receiving unit, and a first signal transmitter transmitting a sensing signal of the first switching element to a bow-string-release-signal receiving device;

a second push unit provided on and protruded from one selected from between the upper and lower mouthpieces; and a second pressure receiving unit provided on a remaining one of the upper and lower mouthpieces and configured to receive the second push unit, the second pressure receiving unit comprising a second switching element sensing a contact between the second push unit and the second pressure receiving unit, and a second signal transmitter transmitting a sensing signal of the second switching element to the bow-string-release-signal receiving device, wherein the first push unit and the first pressure receiving unit form a first signaling pair and are located in positions at which they come into contact with each other when the upper and lower teeth of the user engage with each other, wherein the second push unit and the second pressure receiving unit form a second signaling pair and contact each other when the upper and lower teeth of the user engage with each other, wherein the first signaling pair is spaced from the second signaling pair, and wherein the upper mouthpiece and lower mouthpiece have a first position where the first push unit and the first pressure receiving unit do not contact each other and the second push unit and the second pressure receiving unit do not contact each other, a second position where the first push unit and the first pressure receiving unit contact each other and the second push unit and the second pressure receiving unit do not contact each other and a third position where the first push unit and the first pressure receiving unit contact each other and the second push unit and the second pressure receiving unit contact each other.

5. The device for transmitting as set forth in claim 4, wherein the first pressure receiving unit comprises a casing having an inner surface defining a central recess and an outer surface, wherein the first push unit comprises a column having an outer surface, wherein a diameter of the inner surface of the casing is larger than a diameter of the outer surface of the column, and wherein the switching element is retained within the central recess of the casing and supported by an elastic member.

* * * * *